US006114845A

United States Patent [19]

Capici et al.

[11] Patent Number: 6,114,845

[45] Date of Patent: Sep. 5, 2000

[54] VOLTAGE REGULATING CIRCUIT FOR PRODUCING A VOLTAGE REFERENCE WITH HIGH LINE REJECTION EVEN AT LOW VALUES OF THE SUPPLY VOLTAGE

[75] Inventors: Salvatore Capici, Barrafranca; Filippo Marino, Palermo, both of Italy

[73] Assignee: STMicroelectronics, S.r.l., Agrate Brianza, Italy

[21] Appl. No.: 09/336,358

[22] Filed: Jun. 18, 1999

[30] Foreign Application Priority Data

Jun. 19, 1998 [IT] Italy ..... MI98A1405

[51] Int. Cl.[7] ..... G05F 3/16

[52] U.S. Cl. ..... 323/313; 323/281

[58] Field of Search ..... 323/313, 281, 323/265, 273, 312, 314, 315, 316

[56] References Cited

U.S. PATENT DOCUMENTS 4,260,946 4/1981 Wheatley, Jr. ..... 323/314

5,084,665 1/1992 Dixon et al. ..... 323/281

5,168,209 12/1992 Thiel, V ..... 323/313

*Primary Examiner*—Peter S. Wong

*Assistant Examiner*—Gary L. Laxton

*Attorney, Agent, or Firm*—Theodore E. Galanthay, Esq.; Robert Iannucci, Esq.; Seed IP Law Group, PLLC

[57] ABSTRACT

A voltage regulator circuit produces a voltage reference with high line rejection even for low values of the supply voltage. The regulator is of the type that produces a regulated voltage value for a bandgap voltage generator and includes a regulation circuit portion and a reference circuit portion. The regulation circuit portions is supplied with the supply voltage and has an output at which the regulated voltage value is produced and an input that receives a voltage reference. The reference circuit portion produces the voltage reference and includes a first circuit leg that receives the supply voltage through a controlled switch and a second circuit leg that receives the regulated voltage value.

21 Claims, 5 Drawing Sheets

VOLTAGE REGULATING CIRCUIT FOR PRODUCING A VOLTAGE REFERENCE WITH HIGH LINE REJECTION EVEN AT LOW VALUES OF THE SUPPLY VOLTAGE

TECHNICAL FIELD

This invention relates to a voltage regulating circuit for producing a voltage reference with high line rejection even at low values of the supply voltage, which circuit is effective to produce a regulated voltage value for a bandgap voltage generator.

BACKGROUND OF THE INVENTION

Bandgap regulator circuits for producing voltage references have been known to the designers of analog circuits. These reference circuits provide a constant voltage which is as much as possible independent of the ambient temperature at which the circuit is operated. Circuits of this kind are to be found in several systems formed from integrated circuits.

For example, a constant voltage reference is required for cellular telephone applications, and more particularly for data communication devices based on portable telephone sets. Such sets include at least two low-drop linear regulators which must be made to strict specifications, especially as relates to rejection to the power supply line.

In addition, such regulators arc required to provide a voltage reference that is stable, even when they are supplied low values of supply voltage.

FIG. 1 of the accompanying drawings shows schematically a regulator 1 as above, currently in use with latest generation cellular phones.

The regulator 1 of FIG. 1 comprises an NMOS power transistor M1 which is driven by an operational amplifier 2 being supplied from a charge pump 3.

One input of the amplifier 2 receives a voltage signal Vbg from a bandgap regulator 4, the latter being supplied via a pre-regulator circuit 5 which produces a low-drop voltage Vreg. The pre-regulator 5 is designed to provide an output voltage Vreg with good rejection to the supply line.

This design ensures good rejection to the supply line, since the power supply is itself inherently immune to noise from the supply line VBAT.

Shown schematically in FIG. 2 is one embodiment of a conventional pre-regulator circuit 5.

As can be seen in FIG. 2, the pre-regulator circuit 5 is to be supplied a voltage VBAT, from which the pre-regulated voltage Vreg is then extracted.

FIG. 3 shows schematically, by way of illustration, some embodiments of reference blocks for deriving, from the supply voltage VBAT, the voltage Vref for the pre-regulator circuit 5.

The exemplary reference blocks shown in FIG. 3 have in common the drawback of being sensitive to possible disturbance from the supply line, and consequently, are unable to provide a pre-regulated voltage Vreg that is clear of noise.

The prior art proposes an alternative solution, as shown schematically in FIG. 4. This solution provides for the bandgap regulator to be supplied through a diode-connected transistor.

The last-mentioned solution gives good results from the standpoint of rejection to the supply line, but disallows operation at very low supply voltages, because the lowest working voltage is at least 0.7V (the diode threshold voltage) higher than the voltage that can be used in the previous example incorporating a low-drop pre-regulator.

SUMMARY OF THE INVENTION

An embodiment of this invention provides an electronic regulator circuit structured to produce a voltage reference with high supply line rejection even at low values of the supply voltage.

The electronic regulator circuit provides a bandgap circuit which can be incorporated as part of integrated circuits and can produce a voltage reference which requires no external corrective capacitance and has low power consumption.

The electronic regulator circuit provides, for a pre-regulator, a voltage reference which is only dependent on the supply voltage for the strict duration of the regulator circuit start-up phase.

The regulator circuit includes:

- a regulating circuit portion being supplied the supply voltage and having an output for producing said regulated voltage value and an input for receiving a reference voltage value;
- a reference circuit portion for producing said reference voltage value, which circuit portion comprises a first circuit leg being supplied the supply voltage through a controlled switch, and a second circuit leg being supplied said regulated voltage.

The features and advantages of the invention can be best appreciated by reading the following description of an embodiment thereof, given by way of nonlimitative example with reference to the accompanying drawings.

DETAILED DESCRIPTION

Figure 5:
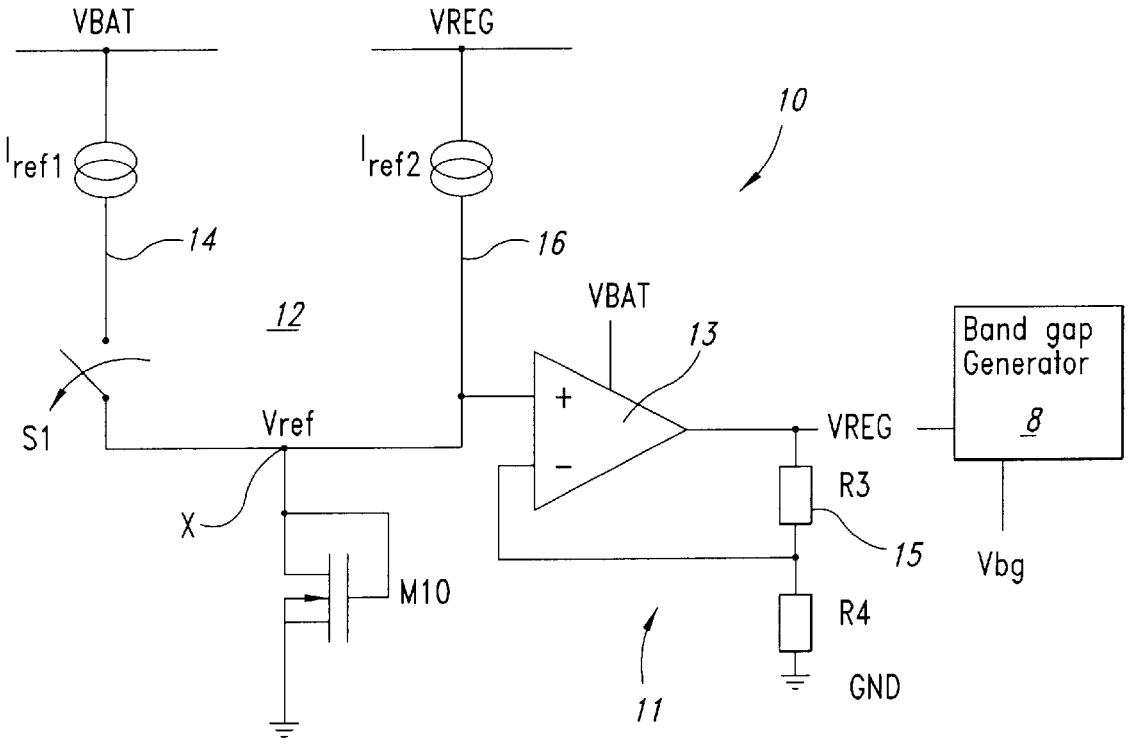
FIG. 5 shows schematically a circuit embodiment according to this invention.

Referring to the drawing views, specifically to the example shown in FIG. 5, the numeral 10 generally and schematically designates a voltage pre-regulator circuit according to an embodiment of this invention.

Figure 1:
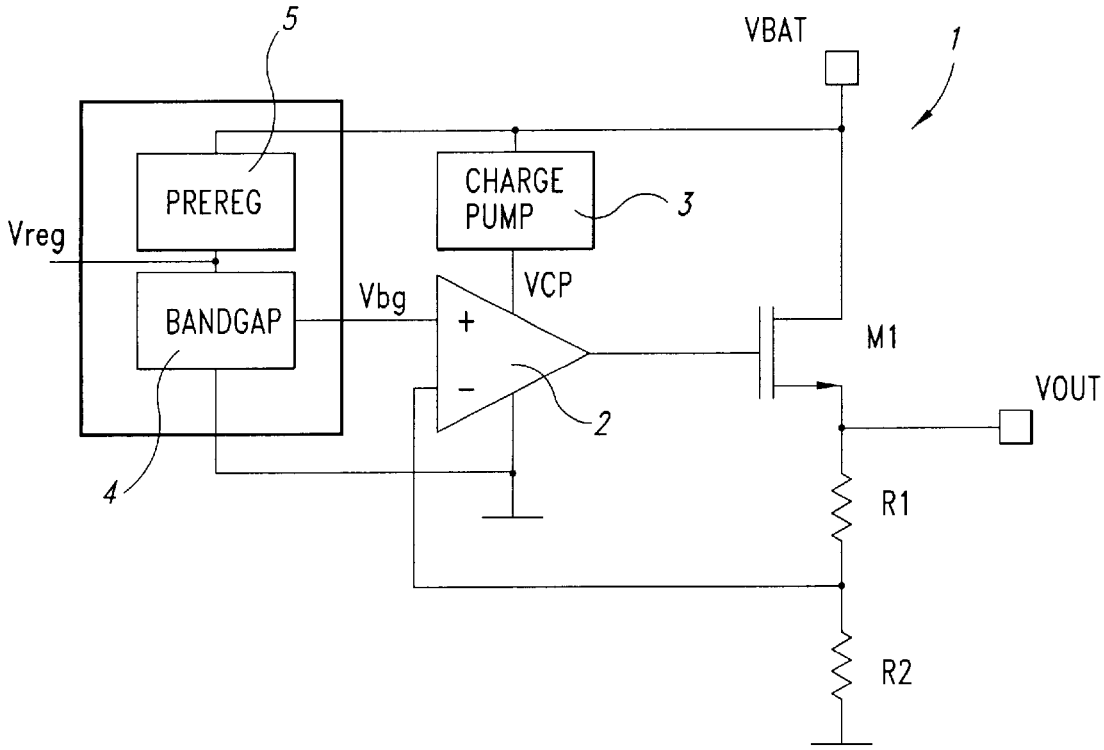
Fig. 1 (Prior Art)
FIG. 1 shows schematically a regulator circuit according to the prior art.
Figure 2:
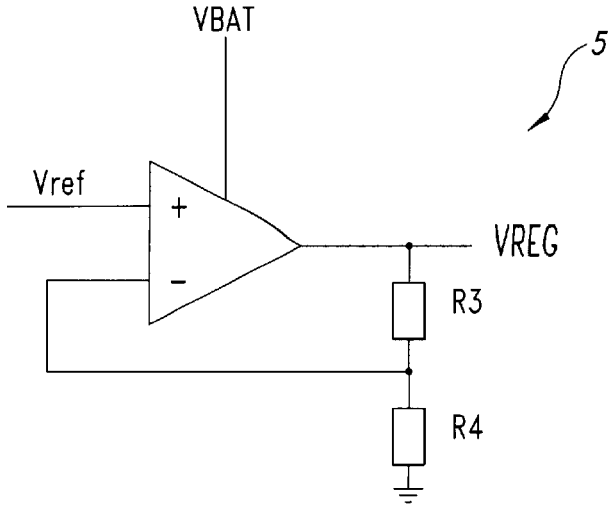
Fig. 2 (Prior Art)
FIG. 2 shows schematically a detail of the circuit in FIG. 1.
Figure 3:
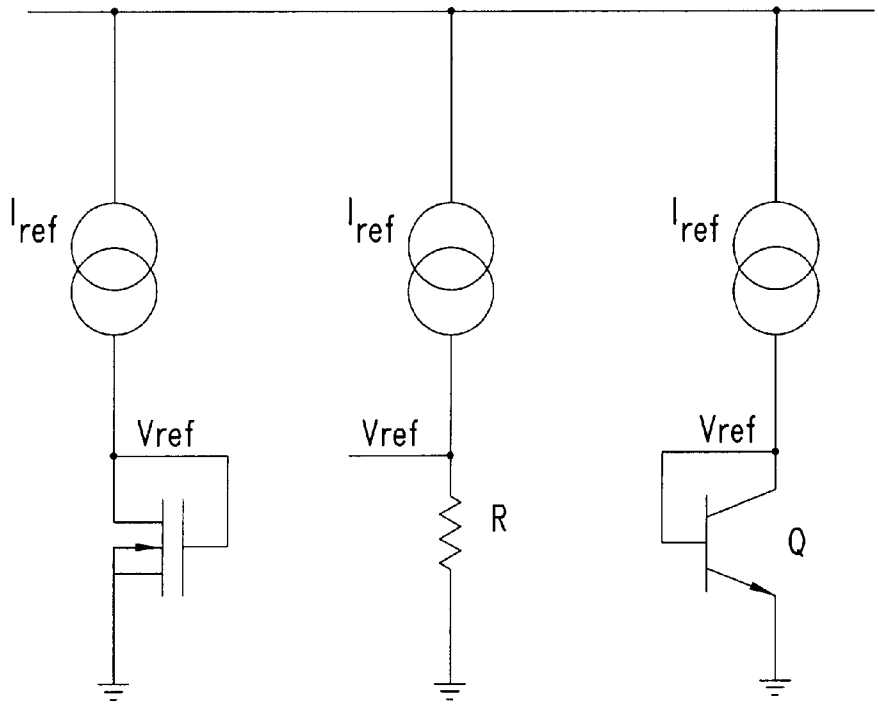
Fig. 3 (Prior Art)
FIG. 3 shows schematically another detail of the circuit in FIG. 1.
Figure 4:
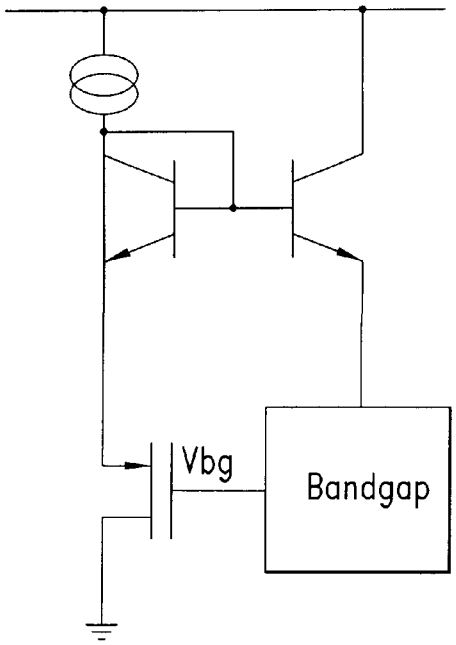
Fig. 4 (Prior Art)
FIG. 4 shows schematically an alternative circuit way of providing the detail in FIG. 2 according to the prior art.

The pre-regulator circuit 10 is associated with a bandgap generator 8 effective to generate a bandgap voltage Vbg. This generator 8 may be of the same type as previously described in relation to block 4 of FIG. 1. Moreover, the bandgap voltage generator 8 and pre-regulator circuit 10 can be incorporated into the regulator circuit 1 (FIG. 1) in place of the bandgap voltage generator 4 and pre-regulator circuit 5.

The circuit 10 is advantageously formed with CMOS technology. However, one could also employ circuits formed with bipolar technology.

The pre-regulator circuit 10 includes a regulating portion 11 and a reference portion 12. The regulating portion 11 includes an amplifier 13 which is supplied a voltage VBAT and has two inputs and one output. A regulated voltage VREG is produced at the output of the amplifier 13.

A resistive divider, designated 15, is formed of a pair of resistors R3, R4 and connected between the output of the amplifier 13 and a ground GND.

The interconnection node between the resistors R3 and R4 of the divider 15 is feedback connected to the inverting (−) input of the amplifier 13.

Advantageously, the reference portion 12 of the circuit is connected upstream of the amplifier 13 to supply a reference voltage Vref value to the noninverting (+) input of the amplifier.

The reference portion 12 comprises a first circuit leg 14 having a series of a first current generator Iref1 and a normally closed, controlled switch S1.

The leg 14 connects the supply voltage reference VBAT to a node X of the reference portion 12, itself connected to the non-inverting (+) input of the amplifier 13.

A second circuit leg 16 of the portion 12 connects a node, whose potential is equal to the regulated voltage Vreg value, to the circuit node X through a second current generator Iref2.

The node X is further connected to the ground GND, through an NMOS transistor M10 connected in a diode configuration. The reference voltage Vref value for the amplifier 13 is picked up from the node X.

The transistor M10 essentially provides a voltage reference, since the voltage across it becomes set once a current is flowing through the transistor. Accordingly, a PMOS transistor or a bipolar transistor, suitably connected in a diode configuration so as to serve as voltage references, could be used instead.

The operation of the pre-regulator 10 will now be described.

Initially, the switch S1 would be closed, and flowing through the diode M10 would be a current Iref1, which depends on the value of the supply voltage VBAT, plus the current Iref2.

The current Iref1 ensures the pre-regulator circuit 10 start-up, while the current Iref2 is dependent on the potential Vreg that represents the output of the preregulator circuit 10.

Thus, the reference voltage Vref value output from the reference circuit portion 12 of the pre-regulator circuit 10 will depend initially on the value of the supply voltage VBAT. But upon the regulated voltage Vreg attaining a sufficient value, the switch S1 will be opened, and the value of the reference voltage Vref will no longer dependent on the supply voltage VBAT.

In this way, a reference value Vref is obtained which affords increased rejection to voltage variations in the supply line.

As a result, the value of the regulated voltage Vreg, which is tied to the reference value Vref, is less affected by the possible appearance of noise in the supply line.

The approach is of the low-drop type and allows the pre-regulator circuit 10 to operate even at low levels of the supply voltage.

Figure 6:
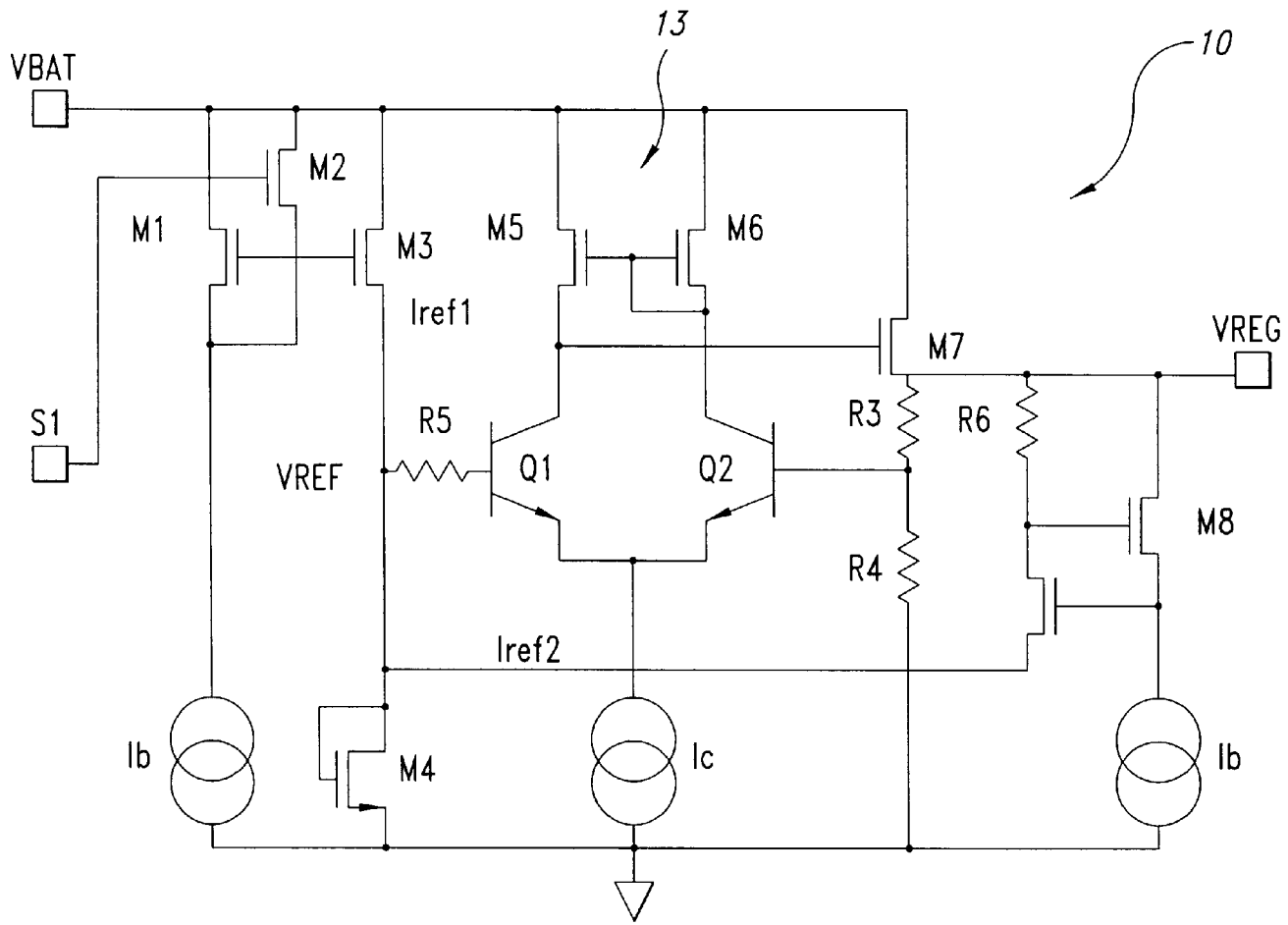
FIG. 6 is a schematic view showing in greater detail the circuit of FIG. 5.

FIG. 6 shows schematically in greater detail the circuit of the pre-regulator 10.

It can be appreciated from FIG. 6 that transistors Q1, Q2, M5 and M6 form the backbone of the amplifier 13, whose structure is then completed by a resistor R5 and a current generator Ic. The output from the amplifier 13 goes through a transistor M7.

The controlled switch SI comprises a MOS transistor M2.

The diode M4 represents the diode M10 of FIG. 5 and provides the reference voltage Vref to the non-inverting input of the amplifier 13 through resistor R5.

Transistors M1, M3 and a current generator Ib form the first current generator Iref1.

The transistor M2 implementing the switch S1 is much more conductive than the transistors M1, M3 in one embodiment. In this embodiment, M2 initially is not conducting and transistor M1, M3 act as a current mirror to drive current through the transistor M3 in an amount proportional to the current produced by the current generator Ib. When the regulated voltage Vreg reaches a predetermined level, the transistor M2 is rendered conductive, which turns OFF transistors M1, M3 and thereby disconnects the supply voltage VBAT from the non-inverting input of the amplifier 13. To turn on the transistor M2 when the regulated voltage Vreg reaches the predetermined level, the control terminal of M2 can be connected to the output of the pre-regulator circuit 10 via a comparator that compares the regulated voltage Vreg with a reference voltage.

Transistors M8, M9 form, in combination with a resistor R6 and the current generator Ib, the second current generator Iref2.

Resistors R3, R4 again form the voltage divider 15.

Figure 7:
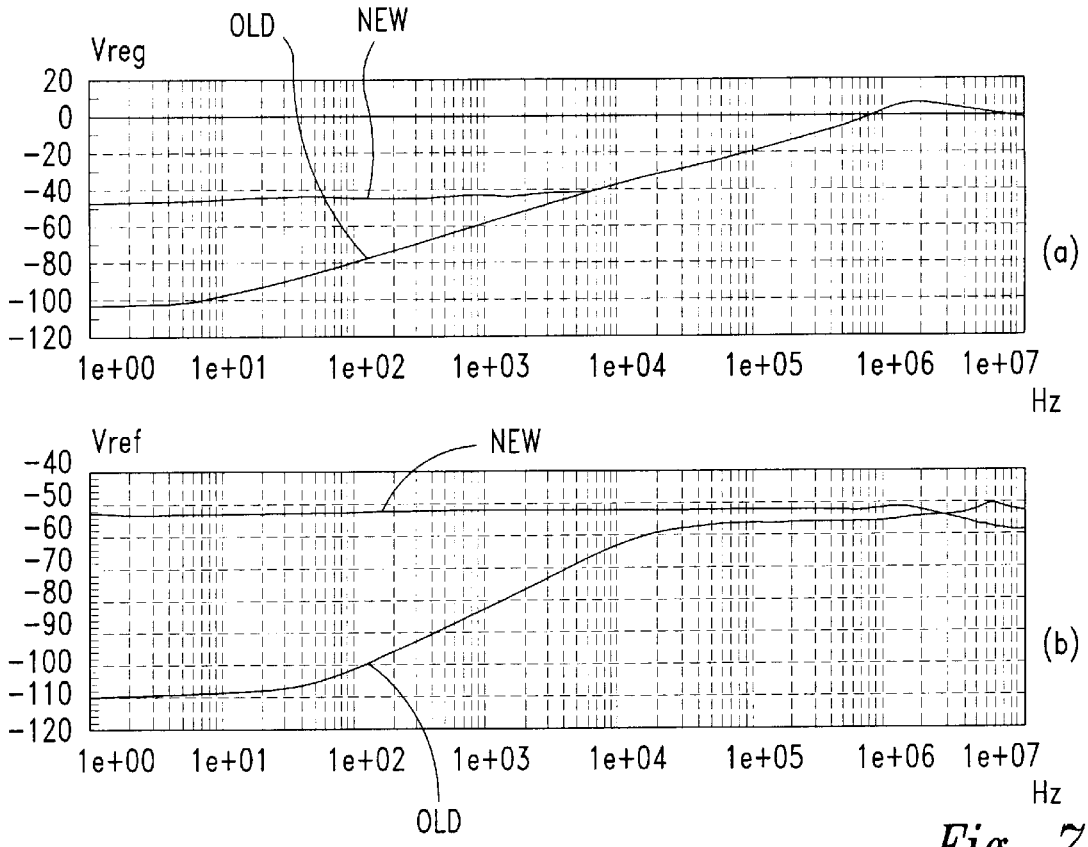
FIGS. 7*a*, 7*b* and 8 show comparative graphs for the circuit design of FIGS. 5–6 and conventional designs.

Shown respectively in FIGS. 7*a* and 7*b* are comparative graphs for the pre-regulator circuit 10 and a conventional design. Specifically, FIG. 7*a* illustrates by comparison the regulated voltages Vreg according to the circuit 10 and the prior art and FIG. 7*b* compares the respective reference voltages Vref.

Figure 8:
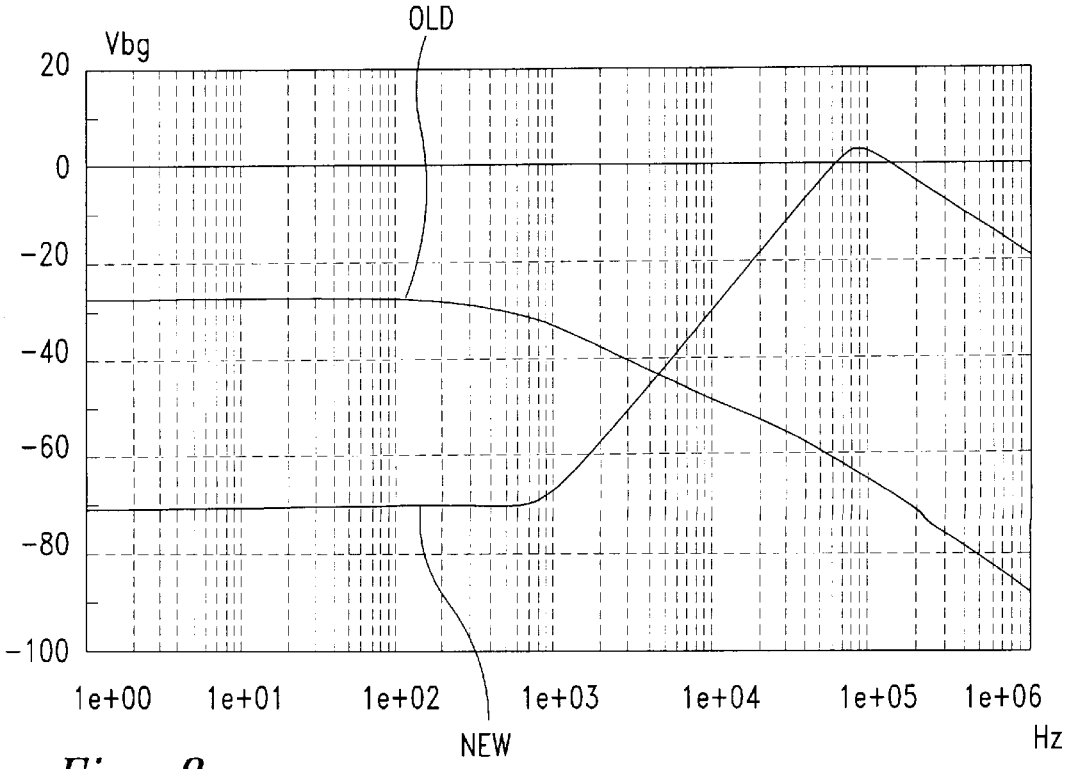

FIG. 8 illustrates by comparison the rejection to the supply line, as indicated by the voltage Vbg produced by the bandgap regulator 8 which is supplied a regulated voltage Vreg respectively from a pre-regulator circuit 10, and from a pre-regulator circuit according to the prior art. In both cases, the comparative results were obtained at relatively low supply voltages close to 2.7V.

As can be seen, throughout the frequency range from DC to approximately 10 kHz, a bandgap voltage Vbg having good rejection to the supply line could be obtained for the pre-regulator circuit 10, even at low values of the supply voltage VBAT.

In summary, the pre-regulator 10 affords a number of advantages, of which the following are noteworthy:

- good rejection to noise appearing in the supply, for the value of the reference voltage produced;
- low power consumption; and
- capability to also operate at low values of the supply voltage.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A voltage regulating circuit for producing a voltage reference with high line rejection even at low values of a supply voltage, which circuit is effective to produce a regulated voltage for a bandgap voltage generator, the voltage regulating circuit, comprising:

a regulating circuit portion supplied with the supply voltage and having an output for producing said regulated voltage and an input for receiving a reference voltage;

a reference circuit portion that produces said reference voltage and includes a first circuit leg being supplied with the supply voltage through a controlled switch and a second circuit leg being supplied with said regulated voltage.

2. A regulator circuit according to claim 1, wherein said first circuit leg comprises a current generator connected in series to said controlled switch.

3. A regulator circuit according to claim 1, wherein said second circuit leg comprises a current generator.

4. A regulator circuit according to claim 1, wherein the first and second circuit legs are connected to a common node, itself connected to the input of said regulating circuit portion.

5. A regulator circuit according to claim 4, wherein said common node is connected to a voltage reference through a transistor in a diode configuration.

6. A regulator circuit according to claim 1, wherein said controlled switch is a MOS transistor.

7. A regulator circuit according to claim 1, wherein the regulating circuit portion includes:

a differential amplifier having a first input and an output corresponding respectively to the input and output of the regulating circuit and also having a second input; and a voltage divider having first resistance connected between the output and second input of the differential amplifier and a second resistance connected between the second input of the differential amplifier and a voltage reference.

8. A voltage regulator circuit comprising:

a bandgap generator circuit having an input that receives a regulated voltage and an output that outputs a regulated bandgap voltage; and a pre-regulator circuit having an output at which the regulated voltage is produced, the pre-regulator circuit including:

a regulating circuit portion supplied with a supply voltage and having an output at which the regulated voltage is produced and an input that receives a first reference voltage; and a reference circuit portion having an output at which the first reference voltage is produced, a first circuit leg coupled between the supply voltage and the output of the reference circuit portion, and a second circuit leg coupled between the output of the regulating circuit portion and the output of the reference circuit portion.

9. The regulator circuit of claim 8 wherein the first circuit leg includes a controlled switch that is closed while the regulated voltage is below a threshold level and is opened upon the regulated voltage reaching the threshold level.

10. The regulator circuit of claim 8 wherein the first circuit leg includes:

a first transistor coupled between the supply voltage and the output of the reference circuit portion and having a control terminal;

a second transistor coupled between the supply voltage and a second reference voltage and having a control terminal coupled to the control terminal of the first transistor; and third transistor coupled in parallel with the second transistor and having a control terminal responsive to the regulated voltage.

11. The regulator circuit of claim 8 wherein the second circuit leg includes a current generator.

12. The regulator circuit of claim 8 wherein the reference circuit portion includes a diode-connected transistor coupled between the output of the reference circuit portion and a second reference voltage.

13. The regulator circuit of claim 8 wherein the regulating circuit portion includes:

a differential amplifier having a first input and an output corresponding respectively to the input and output of the regulating circuit and also having a second input; and a voltage divider having first resistance connected between the output and second input of the differential amplifier and a second resistance connected between the second input of the differential amplifier and a voltage reference.

14. The regulator circuit of claim 8, further comprising:

a charge pump having an input coupled to the supply voltage and an output at which a boosted voltage is produced;

an amplifier having a supply input coupled to the output of the charge pump, a first signal input coupled to the output of the bandgap generator, a second signal input, and an output;

a power transistor having a control terminal coupled to the output of the amplifier, a first conduction terminal coupled to the supply voltage, and a second conduction terminal at which a regulated output voltage is produced; and a voltage divider having a first resistance coupled between the second conduction terminal of the power transistor and the second input terminal of the amplifier and a second resistance coupled between the first resistance and a second reference voltage.

15. A method of producing a regulated voltage using a regulator circuit portion having an input and an output at which the regulated voltage is produced, the method comprising:

coupling the input of the regulator circuit portion to a supply voltage during a first regulating phase;

coupling the input of the regulator circuit portion to the output of the regulator circuit during a second regulating phase; and decoupling the input of the regulator circuit portion from the supply voltage during the second regulating phase.

16. The method of claim 15 wherein the output of the regulator circuit portion is coupled to the input of the regulator circuit portion during the first and second regulating phases.

17. The method of claim 15 wherein the decoupling step includes decoupling the input of the regulator circuit portion from the supply voltage in response to the regulated voltage reaching a threshold level.

18. A voltage regulator circuit comprising:

a reference circuit having a start-up circuit leg and a running circuit leg, the startup circuit leg comprising a first current generator switchably coupled between a power supply voltage and a reference voltage node, and the running circuit leg comprising a second current generator coupled between a regulated voltage node and the reference voltage node;

a regulating circuit including an operational amplifier, the operational amplifier having a non-inverting input coupled to the reference voltage node, having an output coupled to the regulated voltage node, and having an inverting input coupled in a feedback relationship to the regulated voltage node; and a bandgap generator circuit having an input coupled to the regulated voltage node and an output structured to output a regulated bandgap voltage.

19. The voltage regulator circuit of claim 18 wherein the reference voltage node is coupled to a ground voltage through a resistive device.

20. The voltage regulator circuit of claim 19 wherein the resistive device is a diode-connected transistor.

21. The voltage regulator circuit of claim 18 wherein the feedback relationship comprises a resistance network.

* * * * *